United States Patent [19]

Renders

[11] Patent Number: 4,627,328

[45] Date of Patent: Dec. 9, 1986

[54] HYDRAULIC ACTUATOR-CONTROL ARRANGEMENT FOR CONCRETE PUMP

[75] Inventor: Klaus-Helmut Renders, Unna-Stockum, Fed. Rep. of Germany

[73] Assignee: Maschinenfabrik Walter Scheele GmbH & Co. KG, Unna-Massen, Fed. Rep. of Germany

[21] Appl. No.: 652,761

[22] Filed: Sep. 20, 1984

[30] Foreign Application Priority Data

Sep. 20, 1983 [DE] Fed. Rep. of Germany ..... 3333849

[51] Int. Cl.[4] ..... F15B 13/042

[52] U.S. Cl. ..... 91/410

[58] Field of Search ..... 91/342, 330, 410

[56] References Cited

U.S. PATENT DOCUMENTS

| | | | |
|---|---|---|---|
| 917,917 | 4/1909 | White | 91/342 |
| 1,001,821 | 8/1911 | Coffield | 91/342 |
| 2,109,162 | 2/1938 | Boehle | 91/410 X |
| 3,374,713 | 3/1968 | Broughton . | |
| 4,207,803 | 6/1980 | Göttling | 91/410 |

FOREIGN PATENT DOCUMENTS

| | | |
|---|---|---|
| 2454290 | 3/1968 | Fed. Rep. of Germany . |
| 2411391 | 7/1972 | Fed. Rep. of Germany . |
| 2942560 | 4/1981 | Fed. Rep. of Germany . |

OTHER PUBLICATIONS

"Systematik der Hydraulischen Widerstandsschaltungen", Chapter 5.

Article by Lang et al, "Hydraulische Lenkung . . . ", ATZ Automobiltechnische Zeitschrift (6/1974).

F and D Findeisen, *Olhydraulik* (Springer-Verlag, 6/1978), pp. 136–138.

Dürr et al., *Hydraulische Antriebe* (Carl Hanser Verlag, 6/1958), pp. 148, 149.

*Primary Examiner*—Robert E. Garrett

*Assistant Examiner*—Mark A. Williamson

*Attorney, Agent, or Firm*—Karl F. Ross; Herbert Dubno

[57] ABSTRACT

A hydraulic controlling and actuating system has a hydraulic source having a high-pressure side and a low-pressure side and a hydraulic actuator connected to a controlled element and having one compartment pressurizable for moving the element into one of its end positions and another compartment pressurizable for moving the element into the other of its end positions. A control valve for this arrangement has source-side ports connected to the high- and low-pressure sides, respective valve-side ports connected to the actuator compartments, and a valve body displaceable from a center position interconnecting and permitting flow freely between all of the ports into two opposite end positions in one of which the high-pressure source-side port is connected to the one actuator compartment and the low-pressure source-side port is connected to the other actuator compartment and in the other of which the low-pressure port is connected to the one actuator compartment and the source-side port is connected to the other actuator compartment. The valve is so constructed and arranged that on displacement between either end valve position and the center valve position the flow through the valve between the source and the actuator is smoothly and regularly varied from maximum flow in the end valve positions to no flow in the center valve position. A link connected between the actuator and the valve displaces the valve body as the element nears a one of its end positions on displacement therebetween from the respective end valve position to the center valve position.

4 Claims, 8 Drawing Figures

HYDRAULIC ACTUATOR-CONTROL ARRANGEMENT FOR CONCRETE PUMP

FIELD OF THE INVENTION

The present invention relates to a hydraulic actuating and controlling system. More particularly this invention concerns such an arrangement used to displace the distributor pipe of a concrete pump.

BACKGROUND OF THE INVENTION

A standard concrete pump has a hopper adapted to hold the viscous concrete mass and having a front wall formed with a front port at a front axis perpendicular to the front wall at the front port and a rear wall formed with two rear ports centered on respective rear axes perpendicular to the rear wall at the rear ports and generally parallel to the front axis. Respective piston pumps secured to the rear wall outside the hopper over the rear ports can draw portions of the mass out of the hopper and expel the drawn-out portions back into the hopper through the respective rear ports. An outlet conduit is connected to the front wall outside the hopper over the front port. A nonstraight distributor pipe in the hopper has a front end engaged over and aligned with the front port and a rear end engageable over and alignable with either of the rear ports. The distributor pipe can be pivoted about the front axis between one position with the rear end aligned with and engaged over one of the rear ports and with the other rear port opening into the hopper and another position with the rear end aligned with and engaged over the other rear port and with the one rear port exposed in the hopper.

The hopper is filled with concrete and the pumps are operated alternately, with the one expelling concrete into the distributor pipe while the other, whose rear port is exposed in the hopper, draws in a portion. This produces in the distributor pipe and outlet conduit connected to it a nearly continuous flow interrupted only momentarily as the distributor pipe moves between its end positions. It is possible in this manner to displace concrete which is an extremely heavy, abrasive, viscous, and corrosive material that either could not be displaced by any conventional pump or that would quickly destroy it.

Various configurations of such pumps are known, such as described for example in commonly owned U.S. application Nos. 427,180, 427,300, and 427,301 all filed Sept. 29, 1982 as well as in German patent document Nos. 1,285,319, 2,162,406, and 3,045,885 discussed in these U.S. applications. In them the distributor pipe is pivoted back and forth about the front axis by a heavy-duty double-acting hydraulic ram. A set of heavy valves is connected between a pressure source and sump on one side and the three actuators for the two pumps and distributor pipe on the other side to synchronously operate these devices. The reversal of each of the actuators is normally controlled by two position detectors, typically reed-type limit switches that operate the valve solenoids.

In order to make the machine operate more smoothly, it has been suggested on page 35ff of *Hydraulische Arbeitszylinder* by Hans Lang (Krauskopf Verlag, Mainz; 1964) to provide a braking or damping arrangement which is based on restricting the outflow. As a result the cylinder is braked at the end of its stroke by blocking the outflow of the hydraulic liquid with a restriction which, for instance, is controlled by the movement of the cylinder, closing as the cylinder reaches an end position. Such an arrangement continues to subject the working, that is pressurized, compartment of the actuator to full system pressure, which is usually considerable, so that the restriction heats considerably. Typically the cylinder is set so that the piston bottoms at the respective end of the cylinder in its end positions. In such an arrangement most of the system is under very high pressure at all times, leading to premature wear and considerable energy waste.

It has also been suggested to hold the distributor pipe in its end positions by pressing it forcibly against an abutment, as otherwise the mass movement as the other pump draws some of the concrete out of the hopper can pull this pipe out of alignment with the rear port it is receiving concrete from. Any misalignment between the rear end of the pipe and the rear port it is covering leads to substantial wear and rapid equipment failure. Thus the one compartment of the cylinder that displaces the pipe remains fully pressurized while the pipe is receiving concrete and the other compartment is connected directly to the sump. As mentioned above, such constant pressurization is hard on all the related equipment.

OBJECTS OF THE INVENTION

It is therefore an object of the present invention to provide an improved hydraulic controlling and actuating system.

Another object is the provision of such a hydraulic controlling and actuating system which is particularly usable to pivot the distributor pipe of a concrete pump and which overcomes the above-given disadvantages, that is which operates smoothly and shockfree while retaining the pipe in its end positions without strain on the equipment.

A further object is to provide such an arrangement which operates quietly and which is relatively insensitive to temperature.

SUMMARY OF THE INVENTION

A hydraulic controlling and actuating system according to the invention has a hydraulic source having a high-pressure side and a low-pressure side and a hydraulic actuator connected to the element and having one compartment pressurizable for moving the element into one of its end positions and another compartment pressurizable for moving the element into the other of its end positions. A control valve for this arrangement has a source-side port connected to the high-pressure side, a source-side port connected to the low-pressure side, respective valve-side ports connected to the actuator compartments, and a valve body displaceable from a center position interconnecting and permitting flow freely between all of the ports into two opposite end positions in one of which the high-pressure source-side port is connected to the one actuator compartment and the low-pressure source-side port is connected to the other actuator compartment and in the other of which the low-pressure source-side port is connected to the one actuator compartment and the high-pressure source-side port is connected to the other actuator compartment. The valve is so constructed and arranged that on displacement between either end valve position and the center valve position the flow through the valve between the source and the actuator is smoothly and regularly varied from maximum flow in the end valve positions to no flow in the center valve position. Thus in the center valve position all flow is merely in the valve. A link is connected between the actuator and the valve for displacing the valve body at least as the element nears a one of its end positions on displacement therebetween from the respective end valve position to the center valve position.

According to another feature of the invention the link includes a lost-motion coupling engaged between the actuator and valve and having a lost-motion stroke that is somewhat shorter than the stroke of the controlled element between its end positions. This actuator in turn is a double-acting ram having a cylinder and a piston connected to the controlled element and subdividing the cylinder into the compartments. The valve body and piston are generally coaxially displaceable and the lost-motion coupling is engaged axially between them. In addition the lost-motion coupling includes an axial force-transmitting member fixed to the valve body and a plurality of abutments on the member and on the piston engageable on relative movement of the valve body and piston through the lost-motion stroke.

In accordance with a particular feature of this invention the controlled element is the actuating mechanism for a concrete-pump distributor pipe. In addition the end positions of the valve body and controlled element are so oriented that displacement of the control element by an external force out of either of its end positions displaces the valve body in a direction applying pressure to the compartments to correct the externally applied displacement.

DESCRIPTION OF THE DRAWING

The above and other features and advantages will become more readily apparent from the following, reference being made to the accompanying drawing in which.

SPECIFIC DESCRIPTION

Figure 1A:
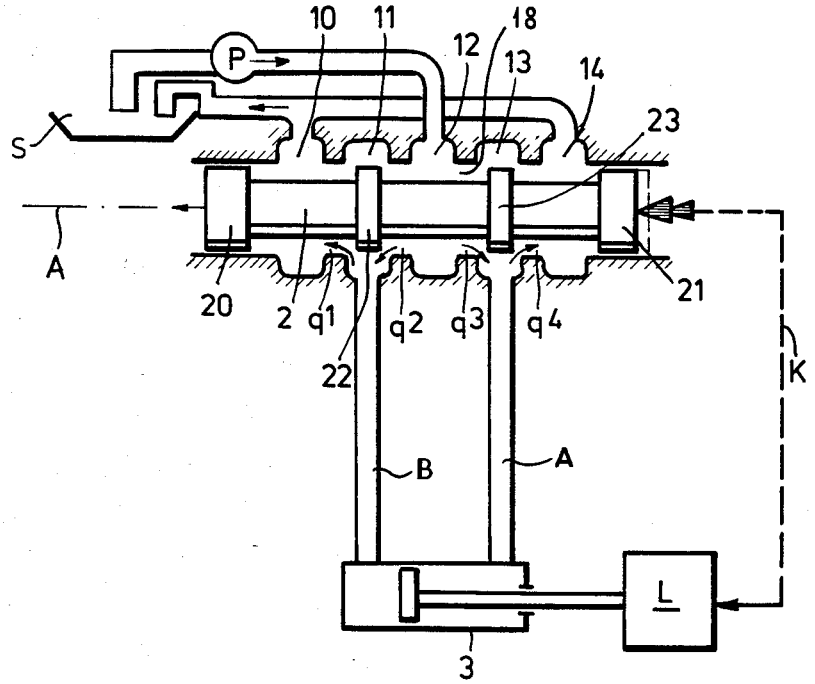
FIG. 1*a* is a largely schematic view of the system of this invention.
Figure 3:
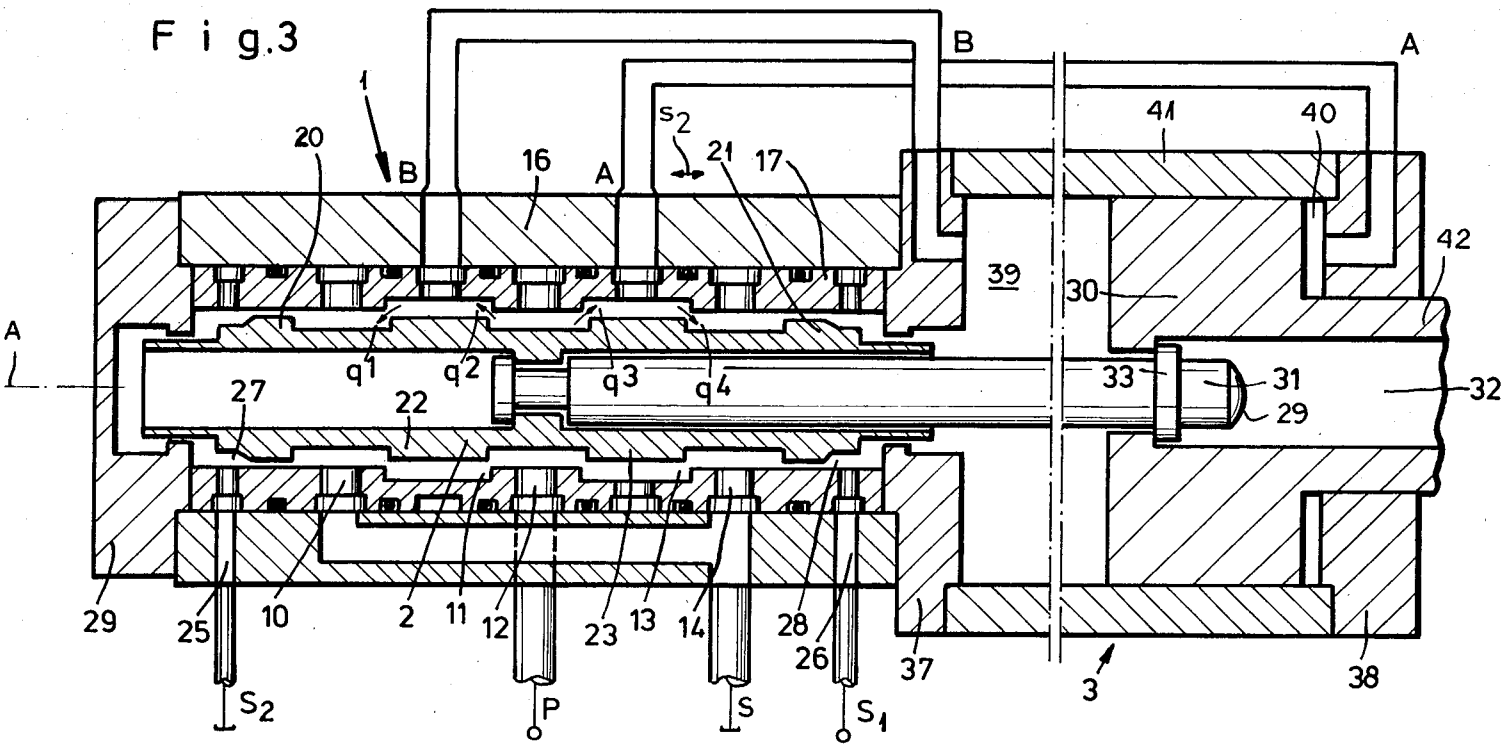
FIG. 3 is an axial section through the valve/actuator assembly of the invention.
Figure 4:
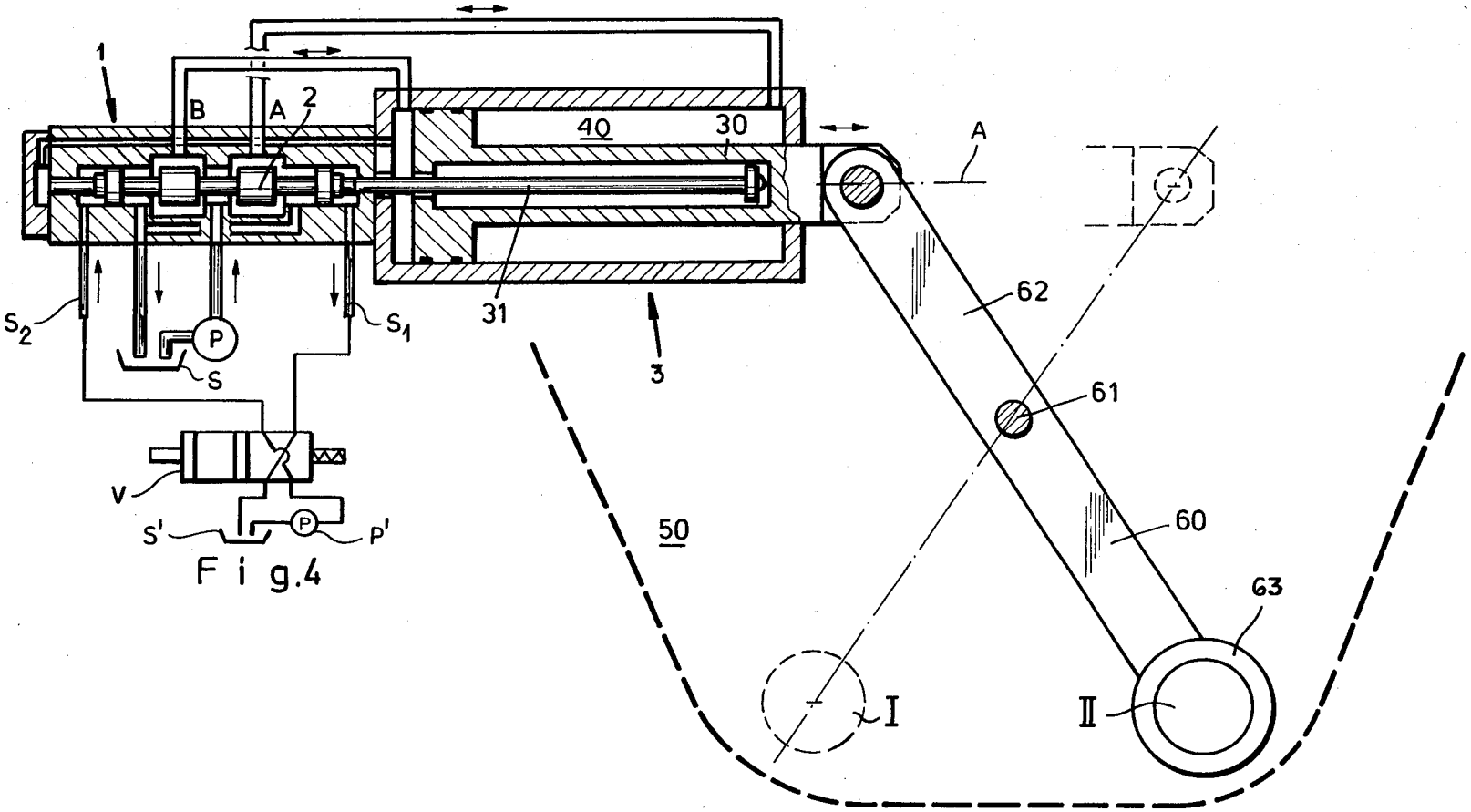
FIG. 4 is a partly diagrammatic view showing the valve/actuator assembly connected to a concrete pump.

As seen in FIGS. 1*a*, 3, and 4 the hydraulic system of this invention basically includes a four-port three-position control valve 1 and a double-acting actuator cylinder 3 controlled by this valve 1 and connected to a schematically illustrated load L in turn connected by a link K to the valve 1. Although the instant invention is not limited to a particular application, FIG. 4 shows the actuator cylinder 3 connected to an arm 62 pivoted at 61 in a concrete-pump hopper 50. Two standard chambers I and II centered on axes parallel to and equispaced from the pivot 61 can be aligned with one end of a distributor pipe 63 carried on another arm 60 pivotally fixed to the arm 62. This one end of this pipe 63 can be aligned with either of the pumping chambers I or II, both of which are provided with respective alternately acting pistons, and the other end of the pipe 63 is coaxial with the pivot 61. In use the hopper 50 is filled with concrete and the pistons of the chambers I and II are alternately reciprocated synchronously with oscillation of the pipe 63 between its end positions aligned with these chambers I and II so that as the concrete in the one chamber I or II is being expelled into the pipe 63 the other chamber I or II is filling by retraction of its piston.

The valve 1 has, as best seen in FIG. 3, a housing formed of an outer housing sleeve 16, an inner sleeve or part 17 coaxial on an axis A with the outer part 16 and forming a chamber 18 centered thereon, and an end plate 29 axially closing the rear end of the chamber 18 defined in the part 17. The inner housing part 17 is formed with five radially inwardly open and axially spaced grooves or compartments 10, 11, 12, 13, 14.

A valve body or spool 2 centered on and displaceable along the axis A in the chamber 18 is formed with two central ridges 22 and 23 having the same axial spacing as the compartments 11 and 13, but both axially somewhat shorter than these compartments 11 and 13. Two end parts 20 and 21 of the spool 2 delimit end compartments 27 and 28. This spool 2 can move axially through a relatively short stroke $s_2$ from its illustrated center position in FIG. 3 in either direction to a position diverting all the output of the pump P into one or the other compartments 11 or 13 while connecting the other compartment 11 or 13 to the sump S.

The two end compartments 10 and 14 are connected together and to a low-pressure sump S and the middle compartment 12 is connected to the high-pressure side of a pump P that normally draws liquid from the sump S. The second and fourth compartments 11 and 13 are connected via outlet conduits A and B to back and front compartments 39 and 40 of the actuator cylinder 3. In addition the housing sleeves 16 and 17 have passages 25 and 26 opening into end regions or compartments 27 and 28 of the chamber 18 and connectable via a two-position reversing valve V (FIG. 4 only) to a respective low-pressure pump P′ and sump S′.

The actuator cylinder 3 has a cylindrically tubular housing 41 centered on the axis A and two end plates 37 and 38, the former also serving as the front end plate delimiting the front end of the compartment 28 of the valve 1. An axially reciprocal piston 30 defines the back and front compartments 39 and 40 connected via the respective conduits B and A to the compartments 11 and 13 of the valve 1. This piston 30 has a rod or stem 42 that projects through the front compartment 40 and that is connected to the element being controlled, here the arm 62. It can move through an axial stroke $s_{30}$.

A lost-motion coupling rod 31 centered on the axis A has a rear end fixed in the tubular spool 2 and a front end carrying an abutment ring 33 loosely received in a chamber 32 of the piston 30 and its stem 42. The front end 29 of this rod 31 can engage the axially backwardly directed front face 43 of the chamber 32 while the rear face 36 of the abutment 33 can engage the axially forwardly directed front face 35 of the chamber 32. Thus the rod 31 and spool 2 can move relatively through an axial stroke $s_{32}$ equal to the axial distance between the faces 35 and 43 minus the axial distance between the end 29 and face 36. The stroke $s_2$ plus the stroke $s_{30}$ is equal to the stroke $s_{32}$, so that the rod 31 forms part of a lost-motion coupling permitting lost motion equal to the stroke $s_{32}$.

Figure 1B:
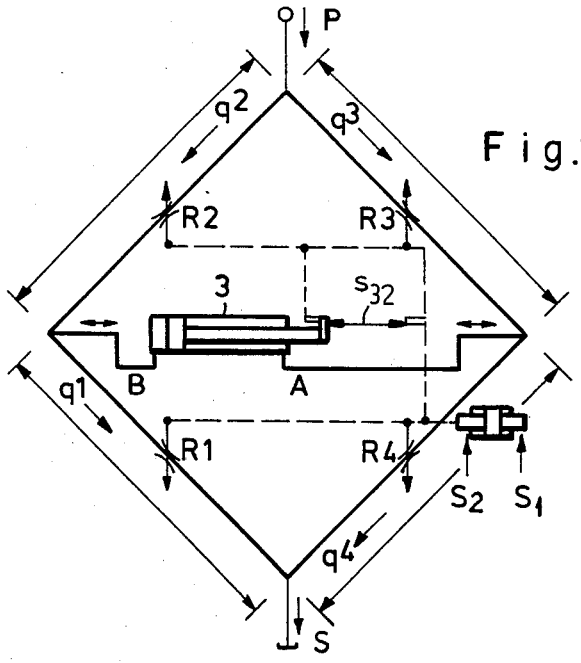
FIG. 1*b* is a diagram illustrating the operation of the system of this invention.

As shown schematically in FIGS. 1*a* and 1*b*, the valve 1 forms four restrictions $R_1$, $R_2$, $R_3$, and $R_4$ having respective volume flow rates $q_1$, $q_2$, $q_3$, and $q_4$. In the central position illustrated in FIGS. 1*a*, 1*b*, 3, and 4 the ridges or control formations 22 and 23 are centered in the compartments 11 and the flow rates $q_{1-4}$ are all identical. This constitutes the holding position for the piston 30 and in fact also returns the piston 30 to whatever position it is being held in as described below.

Movement of the spool 2 back, that is to the left in the drawing, will increase the flows $q_2$ and $q_4$ while decreasing the flows $q_1$ and $q_3$ proportionately and steplessly, and opposite displacement will oppositely and proportionately change the flows. The system therefore acts like an electrical Wheatstone bridge except that the variation with displacement will be parabolic and not linear, since the hydraulic restrictions function differently from electrical resistors.

Figure 2A:
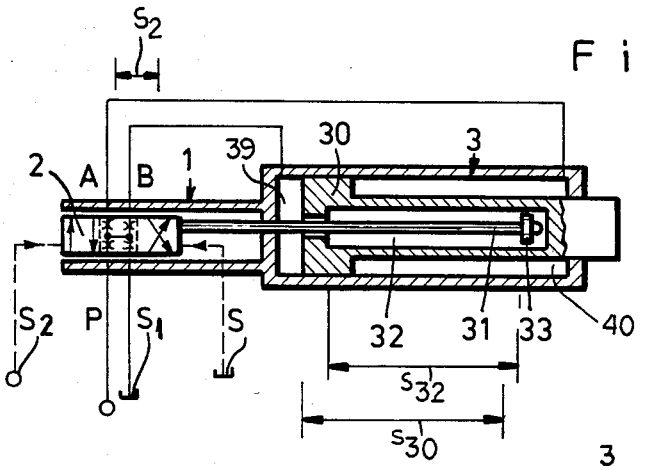
FIGS. 2*a*, 2*b*, 2*c*, and 2*d* are schematic views showing four respective positions of the hydraulic system according to the invention.

The system described above functions as follows:

FIG. 2*a* shows the system in a stable holding position with the valve spool 2 in its middle position and the piston 3 at the back end of its stroke $s_{30}$ and the abutments 29 and 43 touching. The valve V (FIG. 4) applies a relatively weak pressure through line $S_2$ and the pilot bore 25 to the back end chamber 27 and the other line $S_1$ is connected to the opposite chamber 28, so the valve spool 2 is urged to the right. Since the force urging the piston 30 back to the left is much greater than that urging the spool 2 to the right, the parts will hold in this position. In fact if an external force urges the piston 30 back, the four-way action of the valve 1 will be such as to increase the pressure in the compartment 39, urging it forward until the central valve position is again reached. Similarly a force acting in the opposite direction on the piston 30 will increase the pressure in the compartment 40 for similar autocorrective action.

Figure 2B:
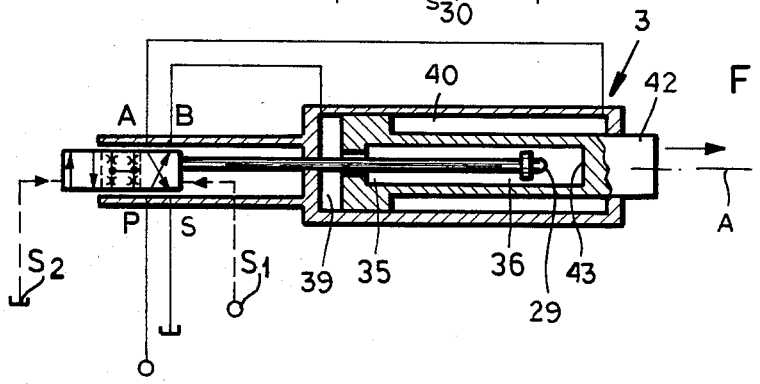

Reversing pressurization in the lines $S_1$ and $S_2$ as shown in FIG. 2*b* will urge the valve body 2 back, pulling the abutments 29 and 43 out of engagement with each other. The valve body 2 will move into a position connecting the back compartment 39 to the pump P and the compartment 40 to the sump S and thereby moving the piston 30 forward to the right with great force. As the piston 30 reaches the end of its stroke $s_{30}$ the abutments 35 and 36 will engage and the piston 30 will axially entrain the spool 2 forward through its short stroke $s_2$ into the middle position shown in FIG. 2*c*. This is another stable position, as the continued pressurization of the front compartment 28 holds the abutments 35 and 36 in snug axial engagement. In addition, as in the FIG. 2*a* position, the arrangement is self-correcting in that an external force applied in either direction to the controlled element will be countered by a complementary correcting force.

Figure 2C:
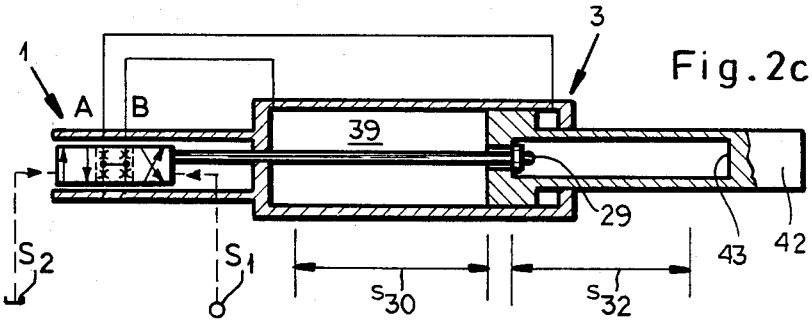

Reversal of the pressurization of the sources $S_1$ and $S_2$ when in the stable FIG. 2*c* position will urge the valve body 2 forward, pulling the abutments 35 and 36 out of engagement with each other. The valve body 2 will move into a position connecting the front compartment 40 to the pump P and the compartment 39 to the sump S and thereby moving the piston 30 backward to the left with great force. Once the piston 30 has traveled through the lost-motion stroke $s_{32}$ and is nearly at the end of its stroke $s_{30}$ the abutments 29 and 43 will engage and the piston 30 will axially entrain the spool 2 back into the middle position shown in FIG. 2*a*. As mentioned above, this is a stable position.

Figure 2D:
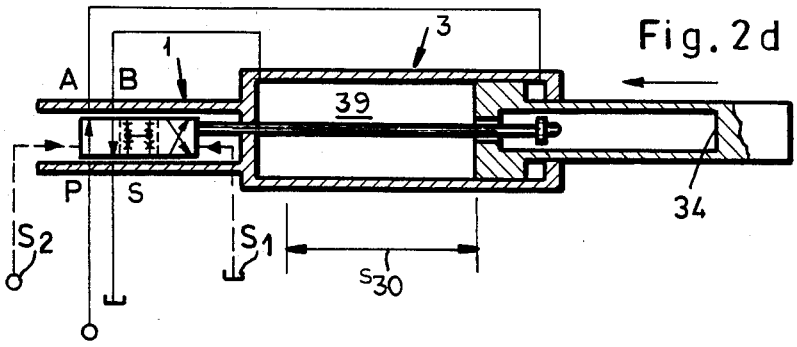

During movement in either direction as illustrated in FIGS. 2*b* and 2*d* the displacement of the piston 30 through the lost-motion stroke $s_{32}$, which accounts for all but a small part of the piston stroke $s_{30}$, is carried out at maximum speed, with the pressure from the high-pressure pump P moving unfettered to the appropriate compartment 39 or 40 and the opposite compartment being vented directly to the sump S. During the last short portion of the piston stroke $s_{30}$ the valve 1 is moved from one of its end positions into its middle position, so that the piston 30 will be smoothly and gently braked until it ends up with both sides at the same pressure and all flow actually being through the valve 1.

Similarly the piston 30 is started up gently and smoothly, as the valve 1 is moved from its center to its end position. The pressurization of the compartments 39 and 40 is not dependent wholly on the piston position, so that if necessary the piston 30 can break free if stuck.

As a result the action of the system of this invention is extremely smooth and shockfree. When used in combination with some piece of equipment like the concrete pump shown partially in FIG. 4, service life can be counted on to be very long as a result of the gentle operation. In virtually any application where a controlled element needs to be moved between two positions and held solidly in either of them, the arrangement of this invention will be very advantageous.

I claim:

1. In combination with a concrete pump having a distributor pipe displaceable by a controlled element between positions corresponding to end positions of the controlled element, a hydraulic controlling and actuating system comprising:

a hydraulic source having a high-pressure side and a low-pressure side;

means including a hydraulic actuator connected to the element and having one compartment pressurizable for moving the element into one of its end positions and another compartement pressurizable for moving the element into the other of its end positions;

a valve having a source-side port connected to the low-pressure side, source-side port connected to the low-pressure side, respective valve-side ports connected to the actuator compartments, and a valve body displaceable from a center position interconnecting and permitting flow freely between all of the ports into two position end postions in one of which the high-pressure source-side port is connected to the one actuator compartment and the low-pressure source-side port is connected to the other actuator compartment and in the other of which the low-pressure source-side port is connected to the one actuator compartment and the high-pressure source-side port is connected to the other actuator compartment, the valve being so constructed and arranged that on displacement between either end valve position and the center valve position the flow through the valve between the source and the actuator is smoothly and regularly varied from maximum flow in the end valve positions to no flow in the center valve position;

reversible operating means for urging the valve body alternatively out of one or the other of its end positions; and link means connected between the actuator and the valve body for displacing the valve body at least as the element nears either of its end positions from the respective end valve position to the center valve position and for retaining the valve body in the center position until the operating means reverses, the end positions of the valve body and controlled element being so oriented that displacement of the controlled element by the external force out of either of its end positions displaces the valve body in a direction applying pressure to the compartments to correct the externally applied displacement.

2. The control-actuator system defined in claim 1 wherein the link means includes a lost-motion coupling engaged between the actuator and valve and having a lost-motion stroke that is somewhat shorter than the stroke of the controlled element between its end positions.

3. The control-actuator system defined in claim 2 wherein the actuator is a double-acting ram having a cylinder and a piston connected to the controlled element and subdividing the cylinder into the compartments, the valve body and piston being generally coaxially displaceable and the lost-motion coupling being engaged axially between them.

4. The control-actuator system defined in claim 3 wherein the lost-motion coupling includes an axial force-transmitting member fixed to the valve body and a plurality of abutments on the member and on the piston engageable on relative movement of the valve body and piston through the lost-motion stroke.

* * * * *